United States Patent [19]

Tsuboi

[11] Patent Number: 4,563,744

[45] Date of Patent: Jan. 7, 1986

[54] APPARATUS FOR ADJUSTING STARTING POSITIONS OF HIGH SPEED INJECTION

[75] Inventor: Hiroyuki Tsuboi, Zama, Japan

[73] Assignee: Toshiba Kikai Kabushiki Kaisha, Tokyo, Japan

[21] Appl. No.: 467,948

[22] Filed: Feb. 18, 1983

[30] Foreign Application Priority Data

Feb. 23, 1982 [JP] Japan ..... 57-26875

[51] Int. Cl.[4] ..... G06F 15/46; G05B 19/18

[52] U.S. Cl. ..... 364/476; 364/167; 364/174; 425/149

[58] Field of Search ..... 364/167, 174, 180, 182, 364/476, 561, 565; 318/590–592, 594; 425/136, 145–149, 177, 542–547; 264/40.6, 40.7; 29/34 R, 149.5 DP

[56] References Cited

U.S. PATENT DOCUMENTS 3,860,801 1/1975 Hunkar ..... 425/145 X
3,920,367 11/1975 Ma et al. ..... 425/149
4,094,940 6/1978 Hold ..... 264/40.6
4,208,176 6/1980 Salerno ..... 425/149 X
4,326,255 4/1982 Fujita ..... 364/476
4,380,801 4/1983 Motomura et al. ..... 364/476 X

*Primary Examiner*—Gary V. Harkcom
*Attorney, Agent, or Firm*—Koda and Androlia

[57] ABSTRACT

A starting position of high speed injection is adjusted by an apparatus comprising a position detector which detects the stroke position of an injection plunger and a computer calculating a first position of the injection plunger at which a high speed injection instruction is given and a second position of the injection plunger at which the injection plunger actually reaches a desired speed. A data input device is provided for presetting in the computer the actual starting position of the injection machine, a theoretical value of a time lag between a starting instruction and an actual starting, and a predicted low injection speed. The computer calculates high speed injection starting speed based on the preset data.

2 Claims, 4 Drawing Figures

APPARATUS FOR ADJUSTING STARTING POSITIONS OF HIGH SPEED INJECTION

BACKGROUND OF THE INVENTION

This invention relates to apparatus for adjusting a starting position of high speed injection in a die cast machine, and more particularly apparatus for maintaining the high speed injection starting position at a definite position.

It is necessary to accurately set a starting position of high speed injection of an injection machine for the purpose of obtaining high quality die cast products. As shown in FIG. 1, in a prior art die cast machine, a limit switch 12 is provided for the piston rod 10 of a die cast or injection machine to be actuated at a predetermined stroke of piston rod 10 so as to start a high speed injection at the predetermined stroke. The limit switch 12 is operated by a lever 14 interlocked with the piston rod 10, and a limit switch 16 actuated by the lever 14 is provided for limiting the return stroke of the piston rod 10.

According to another prior art apparatus a position detector of the piston rod is provided for detecting the stroke thereof, and when the stroke detected by the position detector and a predetermined stroke coincide with each other, an instruction signal is outputted to start high speed injection.

With this prior art apparatus, although the stroke position at which the start instruction for the high speed instruction can be maintained substantially constant, there is a certain time lag between the issuance of the starting instruction and the commencement of the high speed operation of the injection machine effected by a pressurized oil system. Consequently, as shown in FIG. 2, where the injection speed in a low speed injection region is fast (curve A) and low (curve B), although the stroke position $S_1$ at which a starting instruction is issued is the same, the actual starting positions $S_A$ and $S_B$ of the high speed injection are not the same.

SUMMARY OF THE INVENTION

It is an object of this invention to provide novel apparatus for automatically adjusting a starting position of high speed injection capable of maintaining the actual starting position of the high speed injection at a predetermined definite position.

According to this invention, there is provided apparatus for adjusting a starting position of high speed injection, comprising a position detector for detecting a stroke position of an injection plunger; a computer including means for calculating a first position of the injection plunger at which a high speed instruction is given, and a second position of the injection plunger at which the injection plunger actually reaches a desired high speed; means for inputting into the computer the second position, a time interval between the first and second positions, and predicted low injection speeds; and an output circuit issuing a high speed starting signal when the detected position coincides with the first position.

DESCRIPTION OF THE PREFERRED EMBODIMENT

Figure 1:
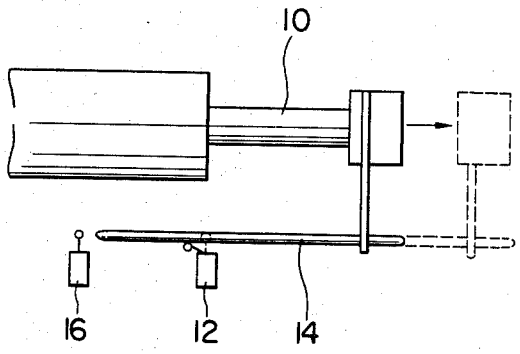
FIG. 1 PRIOR ART
FIG. 1 is a diagrammatic representation showing a prior art injection starting position setting apparatus.
Figure 2:
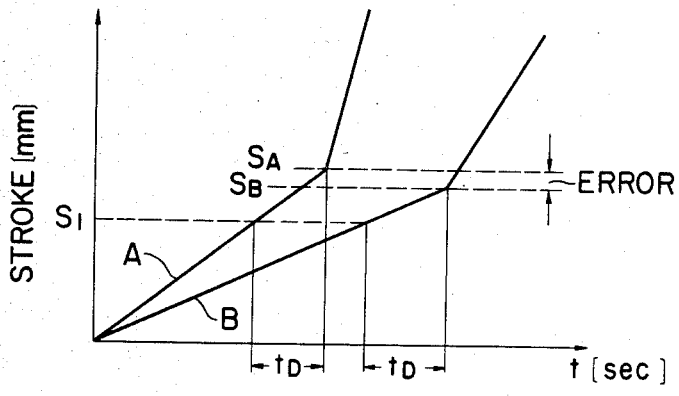
FIG. 2 PRIOR ART
FIG. 2 is a graph showing high speed injection characteristics of an injection machine shown in FIG. 1.
Figure 3:
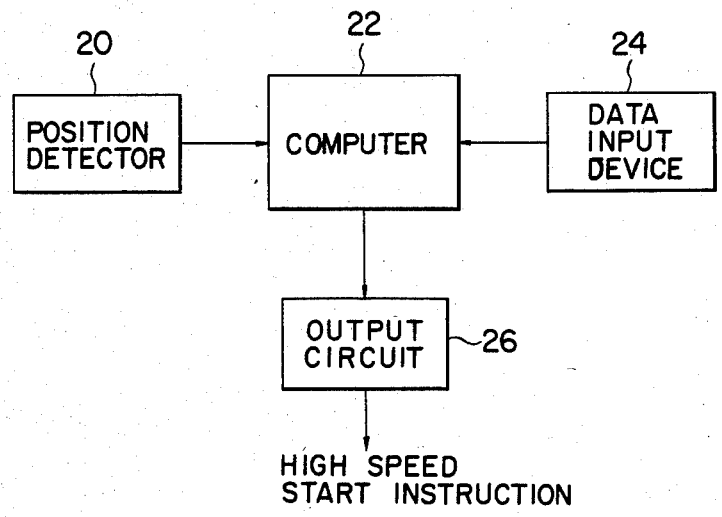
FIG. 3 is a block diagram showing one embodiment of this invention.

A preferred embodiment of this invention shown in FIG. 3 comprises a position detector 20 which detects the stroke position of an injection machine, a computer 22 executing a calculation for setting a high speed injection starting position based on a stroke position signal detected by the position detector 20 and other data, a data inputting device 24 for inputting into the computer 22 data necessary to calculate the high speed injection starting position, and an output circuit 26 producing a high speed starting instruction based on the high speed injection starting position calculated by the computer 22, the high speed starting instruction being supplied to the injection machine to effect high speed injection.

According to this invention, the high speed injection starting position is determined according to the following procedure.

The data inputted by the data input device 24 to the computer 22 include, for example, (1) presetting of the actual starting position of the injection machine, (2) a theoretical value of a time lag between a starting instruction and an actual starting and (3) a predicted low injection speed. Thus, the computer 22 calculates the high speed injection starting position according to the following equation based on the data inputted from the data input device 24.

$$l_{OUT}=l_{START}-(V_L \cdot t_D) \quad (1)$$

where $l_{OUT}$: high speed injection starting position, $l_{START}$: preset actual starting position, $V_L$: low injection speed preset value, $t_D$: preset delay time.

In this manner, the computer 22 determines the stroke position $l_{OUT}$ at which a starting instruction for the high speed injection is produced.

As the injection machine starts to operate, the computer 22 performs the following correction calculation.

(1) A low injection speed $V'_L$ is calculated according to the following equation based on the stroke position signal produced by the stroke position detector 20 and time data obtained from a clock signal in the computer 22.

$$V_L = \frac{\text{low speed region}}{\text{time necessary for passing through low speed region}} \quad (2)$$

Figure 4:
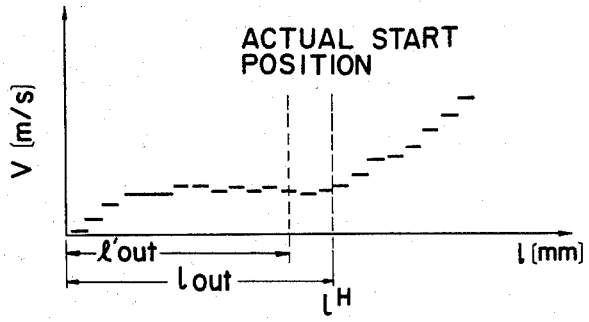
FIG. 4 is a graph showing the result of calculation of the speed data calculated by the computer shown in FIG. 3.

The low injection speed $V'_L$ thus calculated by a divider, not shown, is shown in FIG. 4 as speed data per unit length of the stroke. As a consequence, a stroke position $l_H$ at which the injection speed changes from the low speed $V'_L$ to a high speed can be obtained from the low injection speed $V'_L$.

(2) Based on the calculation described in item (1), the high speed injection starting position at the next step is calculated as follows by correcting the previously set high speed injection starting position $l_{OUT}$.

$$l'_{OUT}=l_{START}-(l_H-l_{OUT}) \quad (3)$$

When the high speed injection starting position thus calculated by the computer 22 coincides with the stroke position detected by the position detector 20, the computer 22 causes the output circuit 26 to produce a high speed injection starting instruction. For this purpose suitable comparator or subtractor can be used.

Thus, according to this invention, when the injection machine is preset with an actual starting position at which the injection speed becomes high at a predetermined stroke position, the high speed injection starting position at which the start instruction is issued can be adjusted automatically by performing a calculation such that the actual starting position would always be constant by taking into consideration the low injection speed and a time lag between the high speed injection start signal and the actual starting position.

When executing a correction calculation of the high speed injection starting position of the next injection step with the computer 22, an average value of the difference ($l_H-l_{OUT}$) between the actual starting position $l_U$ and the set value of the high speed injection position $l_{OUT}$ of several injection steps is obtained by using an adder and a divider and equation (3) may be calculated by using the average value.

Where the low injection speed of the injection machine is to be changed, the automatic adjusting can be accomplished by merely varying the predicted value $V_L$ of the low injection speed, which can be made with a variable resistor.

As can be noted from the foregoing description, according to this invention the actual starting position of the high speed injection at various injection steps can always be automatically adjusted to a definite stroke position without being influenced by the low injection speed. Moreover, the automatic adjusting apparatus of this invention can be readily fabricated with a microcomputer having, memory, calculation and control performances and can improve the performance and reliability of the high injection starting position setting means.

Although in the foregoing, a preferred embodiment of this invention has been described it will be clear that many changes and modifications will be obvious to one skilled in the art without departing from the scope of the invention as defined in the appended claims.

What is claimed is:

1. Apparatus for adjusting a starting position of high speed injection in a die cast machine, comprising:

a position detector for detecting a stroke position of an injection plunger;

a computer including means for calculating a first position of said injection plunger at which an instruction signal for starting a high speed injection is generated, and a second position of said injection plunger at which said injection plunger actually reaches a desired speed;

data input means for presetting into said computer a predicted time interval ($t_D$) between an instant at which said instruction signal for starting a high speed injection is generated and an instant at which the plunger speed actually changes to said high speed, a predicted low injection speed ($V_L$) and a desired position ($l_{START}$) of the plunger at which the plunger speed actually changes to said high speed, said calculating means, based upon said preset data, determining said first position ($l_{OUT}$) corresponding to an initial state of the injection plunger stroke operation in accordance with the following first equation:

$$l_{OUT}=l_{START}-(V_L \cdot t_D)$$

and, then determining said first position ($l'_{OUT}$) corresponding to at least one successive stroke operation of the injection plunger in accordance with the following second equation:

$$l'_{OUT}=l_{START}-(l_H-l_{OUT})$$

where $l_H$ represents said second position calculated at at least one successive stroke operation of the injection plunger; and an output circuit means responsive to an output of said computer for issuing said instruction signal for starting high speed injection of said injection plunger when said detected position of the injection plunger coincides with said first position during at least one stroke operation of the injection plunger.

2. The apparatus according to claim 1, wherein said computer further comprises means for effecting corrective calculation of said first position by calculating an average value of ($l_H-l_{OUT}$).

* * * * *